US005375886A

United States Patent [19]

Tsuchiya

[11] Patent Number: 5,375,886

[45] Date of Patent: Dec. 27, 1994

[54] COUNTERFEIT-PROOF PAPER FOR DISCOURAGING ATTEMPT AT REPRODUCTION WITH COPYING DEVICE

[75] Inventor: Shohei Tsuchiya, Tokyo, Japan

[73] Assignee: Hosokawa Printing Co., Ltd., Tokyo, Japan

[21] Appl. No.: 46,842

[22] Filed: Apr. 14, 1993

[51] Int. Cl.[5] ..... B42D 15/00

[52] U.S. Cl. ..... 283/93; 283/902

[58] Field of Search ..... 283/95, 902, 72, 85; 428/916

[56] References Cited

U.S. PATENT DOCUMENTS

| | | | |
|---|---|---|---|
| 4,780,397 | 10/1988 | Tsuchiya . | |
| 5,078,428 | 1/1992 | Maeno . | |
| 5,149,140 | 9/1992 | Mowry, Jr. et al. | 283/902 X |
| 5,170,040 | 12/1992 | Orndorff | 283/902 X |
| 5,193,853 | 3/1993 | Wicker | 283/902 X |

*Primary Examiner*—Willmon Fridie

*Attorney, Agent, or Firm*—Wenderoth, Lind & Ponack

[57] ABSTRACT

A counterfeit-proof paper which discourages an attempt at reproduction of the print made thereon is disclosed. Since this paper has an apparently planar surface, the latent image contained therein escapes perception with unaided eyes. Once this paper is subjected to a copying action of a copying device, the latent image is made to appear clearly regardless of the type of copying device, the direction of scanning light, or the manner of placing the paper relative to the copying device. Specifically, either of a latent image and a background conferred upon the surface of a substratum paper is formed of mesh points of a 150-line 10% level and the remainder thereof is formed of concentric circular patterns. The thin lines forming the circles of the concentric circular patterns have a thickness of 1/10 mm and are spaced with an interval of about ½mm.

8 Claims, 4 Drawing Sheets

COUNTERFEIT-PROOF PAPER FOR DISCOURAGING ATTEMPT AT REPRODUCTION WITH COPYING DEVICE

BACKGROUND OF THE INVENTION

1. Field of the Invention

This invention relates to a counterfeit-proof paper capable of discouraging an attempt at reproduction of the print thereon with a copying device and adaptable for a wide range of copying devices without reference to form of copying device or direction of light scanning.

2. Prior Art Statement

For the purpose of preventing important papers such as negotiable securities and official documents from being forged with a copying device, various techniques have been proposed for the production of a paper having initially conferred upon the surface of a substratal paper a latent image in the form of such warning letters as "VOID," "COPY," or "COUNTERFEIT," which latent image is initially indiscernible with unaided eyes and is made to be visually perceptible in contrast to the background of the paper when the paper is subjected to a copying action of the copying device (refer, for example, to Japanese Examined Patent Publications No. 58-47,708 and No. 64-5,835).

The technique of the former invention comprises printing a latent image with large mesh points reproducible with a copying device, printing the background of the paper surrounding the latent image with small mesh points unreproducible with the copying device, and conferring a camouflage pattern upon the paper simultaneously with the printing of the latent image and background, wherein the camouflage pattern as a finely divided figure interferes with the latent image and background to the extent of rendering the latent image and background imperceptible with unaided eyes. The technique of the latter invention comprises forming either of a latent image and a background with mesh points unreproducible with a copying device, forming the remainder thereof with a multiplicity of parallel lines reproducible with the copying device, and at the same time printing on the upper surface of the latent image a decorative pattern in a light color unreproducible by copying.

SUMMARY OF THE INVENTION

Incidentally, the latent image must be such that it is normally invisible and is made clearly discernible by subjecting the paper to a copying action of the copying device. For the latent image to become clearly perceptible in consequence of the copying action, the former technique mentioned above requires widening of the difference in size of the mesh points to an extreme extent. If this difference is unduly large, however, since the latent image betrays its own presence to the visual sense before the copying action in spite of the camouflage pattern, this technique is at a disadvantage in suffering the surface of the paper to be divested of naturalness and consequently depriving the paper itself of practical utility.

As a result, it becomes necessary to impose a limit on the ratio of the large to small mesh points. The limited ratio, however, renders the difference in darkness and lightness of the large and small mesh points produced with the copying device undiscernible and compels the camouflage pattern to produce a finely divided figure in the large and small mesh points. Thus, this technique is disadvantageous in that the latent image fails to manifest itself clearly in the copy and prevents itself from bringing about the desired effect of discouraging an attempt at counterfeiting.

The technique of the latter invention which does not resort to the combination of mesh points similar in shape is at an advantage in enabling the multiplicity of parallel lines to manifest themselves relatively clearly because they enjoy ample reproducibility relative to the mesh points. This technique, however, is unfit for documents which have no use for a decorative pattern. Apart from the question of the decorative pattern, since the multiplicity of lines are longitudinal lines, lateral lines, or oblique lines in themselves, they have inferior reproducibility when they do not coincide with the direction of scanning light in the reproducing device, though they manifest clearly when they coincide with the direction of scanning light. This technique is at a disadvantage, however, in that the latent image will possibly fail to manifest itself as clearly as desired and further that the paper suffers from an unsightly surface because the part in which the longitudinal lines and the linear rows of mesh points closely approximate to each other is unduly dark and the part in which they spaced excessively from each other forms a space void of color.

This invention has been produced as a result of a diligent study pursued with a view to overcoming the drawbacks of the prior art mentioned above. It specifically aims to provide a counterfeit-proof paper which prevents a latent image contained originally therein from being clearly discerned with unaided eyes and allows the surface thereof to be finished beautifully and, on being subjected to a copying action of a monochromic or color copying device, enables the latent image to become clearly perceptible and enjoy uniformity without reference to the direction of scanning light of the copying device and the manner of placing the paper relative to the copying device. Thus, the counterfeit-proof paper of this invention works with virtually every copying device.

BRIEF DESCRIPTION OF THE DRAWINGS

The invention will be better understood and objects and features thereof other than those set forth above will become apparent when consideration is given to the following detailed description thereof, which makes reference to the annexed drawings wherein.

DETAILED DESCRIPTION OF THE INVENTION

Figure 1:
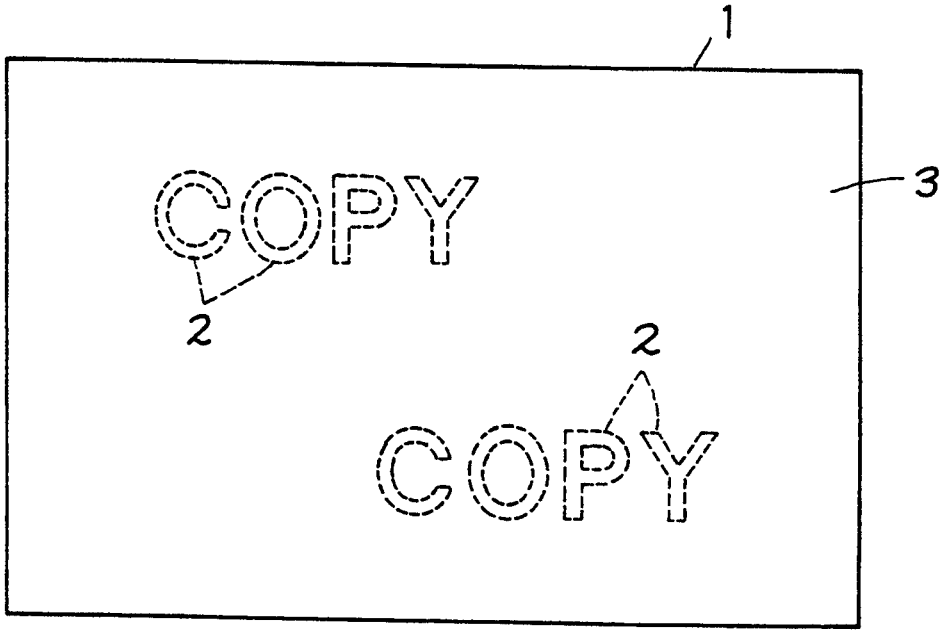
FIG. 1 is a plan view illustrating schematically a paper of this invention.

To accomplish the object described above, this invention adopts the following technical measure. To be specific, this invention is directed to a counterfeit-proof paper for discouraging an attempt at reproduction of the print thereon with a copying device. The counterfeit-proof contains an initially virtually indiscernible latent image which is made visually perceptible when the paper is subjected to a copying action of the copying device owing to the difference in darkness and lightness brought about consequently between the latent image and the background of the paper. The paper is characterized by the fact that the latent image conferred upon the surface of a substratum paper is formed of approximately 150-line 10% mesh points, the background of the paper other than the latent image is formed of concentric circular patterns of the same color as the mesh points, and the thin lines forming the circles of the concentric circular patterns have a thickness of about 1/10 mm and are spaced with an interval of about ½ mm.

Optionally, the latent image on the surface of the substratum paper may be formed of concentric circular patterns and the background of the paper other than the latent image may be formed of mesh points of about a 150-line 10% level. Even in this case, the thin lines forming the circles of the concentric circular patterns have a thickness of about 1/10 mm and are spaced with an interval of about ½ mm.

It is also permissible to incorporate in conjunction with the latent image and background in a one-layer one-color print a camouflage pattern adapted to interfere with the latent image and background or to print over the latent image at a proper portion thereof a color pattern of a transparent ink of light color not readily reproduced by copying.

The latent image and the background share a common color and the thin lines forming the concentric circular patterns are present in a very large number like the mesh points and are so inconspicuous as to normally defy discrimination from the mesh points. Thus, the latent image and the background appear to unaided eyes to be lying evenly in one plane.

The mesh points of the 150-line 10% level are not reproduced by the copying device and the part of the paper formed thereby appears in a light color in the copy. The thin lines having a thickness of 1/10 mm and spaced with an interval of about ½ mm are reproduced by the copying device and, as a result, the concentric circular patterns appear in a dark color. Thus, the mesh points and the thin lines give rise to a sharp contrast sufficient for the latent image to be clearly discriminated from the background.

When the surface of the substratum paper incorporates the camouflage pattern therein, the difficulty of discriminations between the latent image and the background is increased because the camouflage pattern forms a finely divided figure.

When the color pattern is formed on the latent image in a proper portion thereof, the latent image is concealed and the color pattern alone is allowed to appear on the paper.

EXAMPLE

Figure 2:
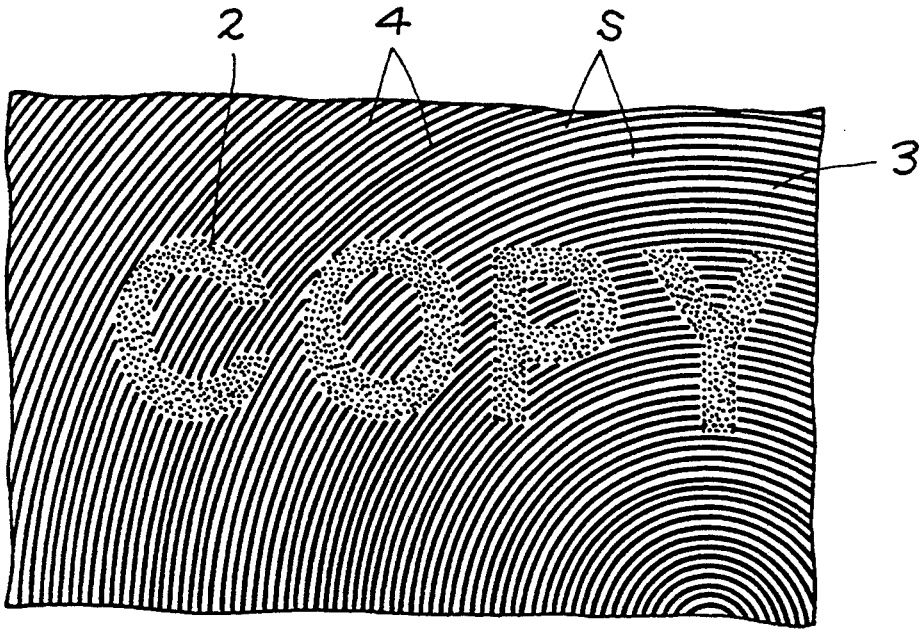
FIG. 2 is a diagram illustrating part of the paper of FIG. 1 on an enlarged scale.

FIG. 1 and FIG. 2 represent a paper of this invention. A latent image 2 indicated with the letters "COPY" on the surface of a substrate paper 1 is formed of minute mesh points of the 150-line 10% level incapable of being reproduced by a copying device. This latent image 2 may be formed at one place or at a plurality of places. It may be indicated with such letters as "VOID," "INVALID," "COUNTERFEIT," etc.

A background 3 of the paper other than the latent image 2 is formed with concentric circular patterns of the same color as the mesh points. Thin lines 4 which form the circles of the concentric circular patterns are not disposed parallel to series of mesh points forming the latent image and, therefore, do not give rise to any empty space jointly with the mesh points or to overlap the mesh points.

Figure 3:
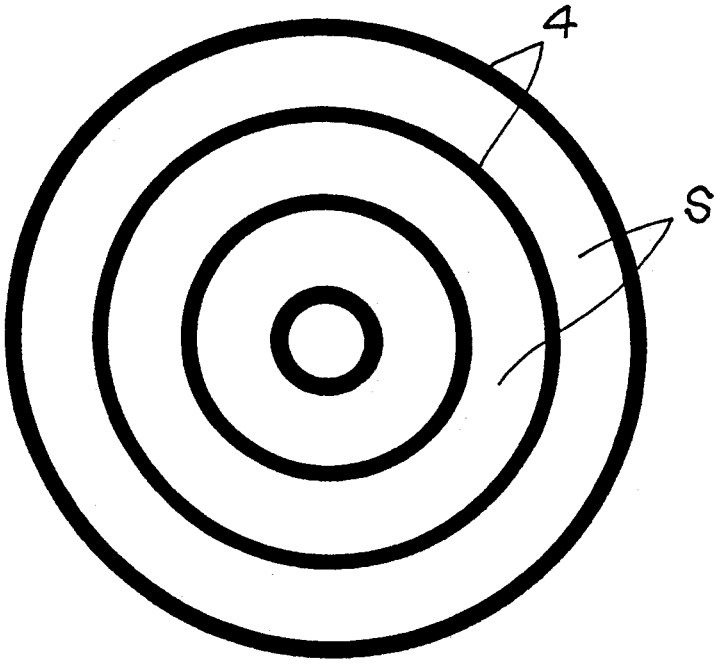
FIG. 3 is a diagram illustrating part of thin lines forming circles of a concentric circular pattern on an enlarged scale.

FIG. 3 illustrates the thin lines 4 on an enlarged scale. These thin lines have a thickness of 1/10 mm and are spaced with an interval of about ½ mm. Owing to the thickness of 1/10 mm, the thin lines are normally barely perpectible with unaided eyes, though they are reproducible with a copying device. Then, owing to the very small interval S of ½ mm used for spacing the thin lines, the concentric circular patterns are perceived uniformly in one plane and are able to obscure the boundaries thereof with the mesh points.

Figure 4:
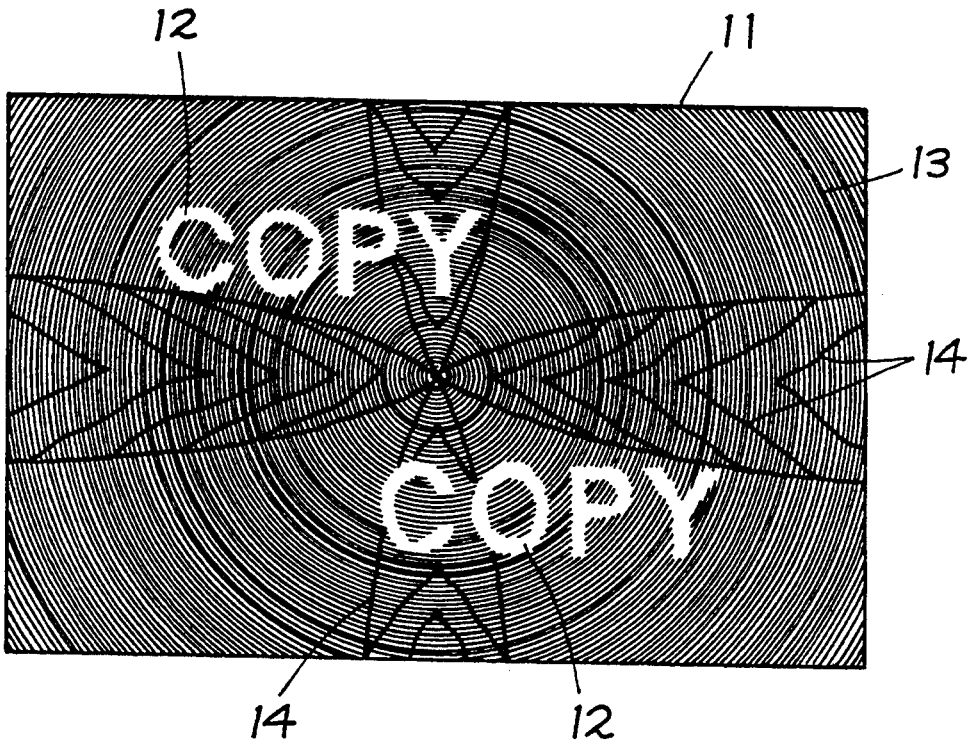
FIG. 4 is a plan view illustrating the paper of FIG. 1 in a state assumed when the paper is subjected to a copying action of a color copying device.

FIG. 4 illustrates a copy of this paper obtained by the use of a color copying device. On a copying paper 11, a latent image 12 manifests itself in a light color and a background 13 manifest itself in a dark color and, at the same time, a moire 14 is produced on the background 13. This phenomenon is peculiar to the mutual interference which arises between the concentric circular patterns which are aggregates of numerous circles each formed of thin lines and the regular color repeatability of the scanning lines of the color copying device. Owing to the occurrence of this moire 14 and the contrast between the latent image 12 and the background 13, the paper is discerned to be a product of copying.

Figure 5:
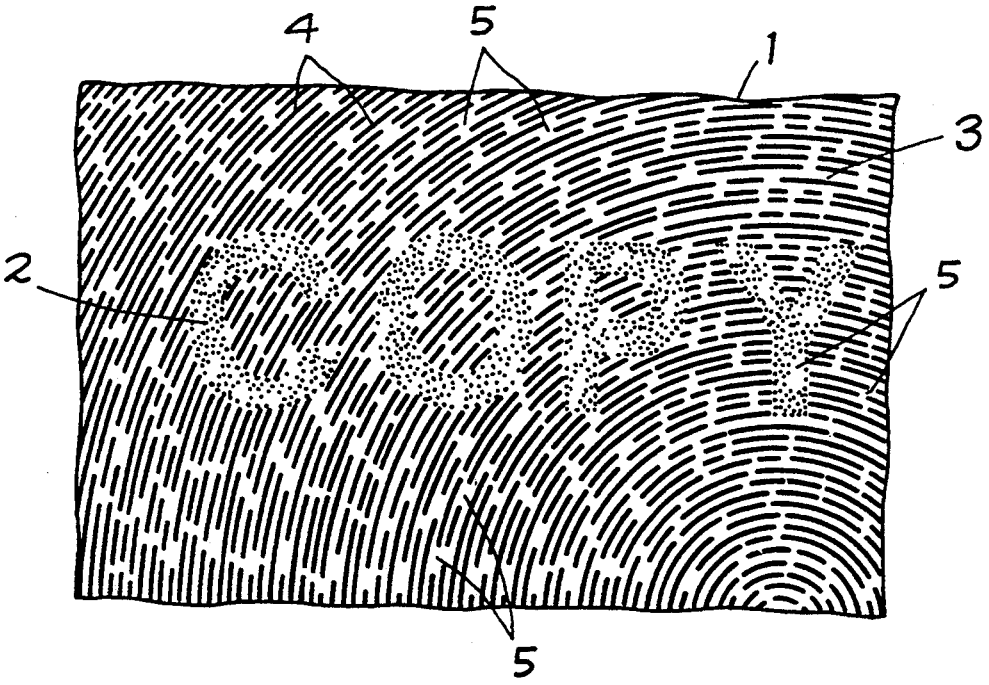
FIG. 5 is a diagram illustrating the paper of this invention incorporating therein a camouflage pattern on an enlarged scale.

FIG. 5 depicts a working example having a camouflage pattern 5 incorporated in the latent image 2 and the background 3 on the substratum paper 1. This example requires no extra printing steps because this camouflage pattern 5 is formed in the one-layer one-color printing method simultaneously with the latent image 2 and the background 3.

Incidentally, the camouflage pattern 5 is not reproduced with a copying device, it manifests as a void figure in a copy. Thus, the thin lines 4 which manifest themselves in the copy are in a state severed by the void figure.

Figure 6:
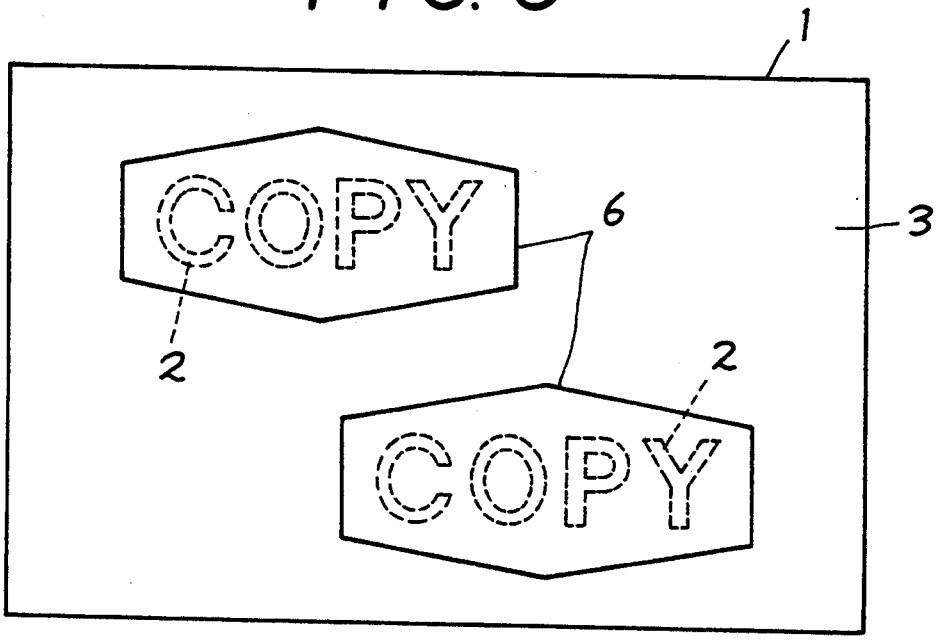
FIG. 6 is a plan view of the paper of this invention having a color pattern printed on a latent image.

FIG. 6 depicts a working example in which a color pattern 6 is printed on the latent image 2 on the substratum paper 1 at a suitable part thereof. The color pattern 6 is of a transparent ink of light color not easily reproduced by copying. By this color pattern, the latent image is concealed. The paper in this case requires printing in two steps.

Figure 7:
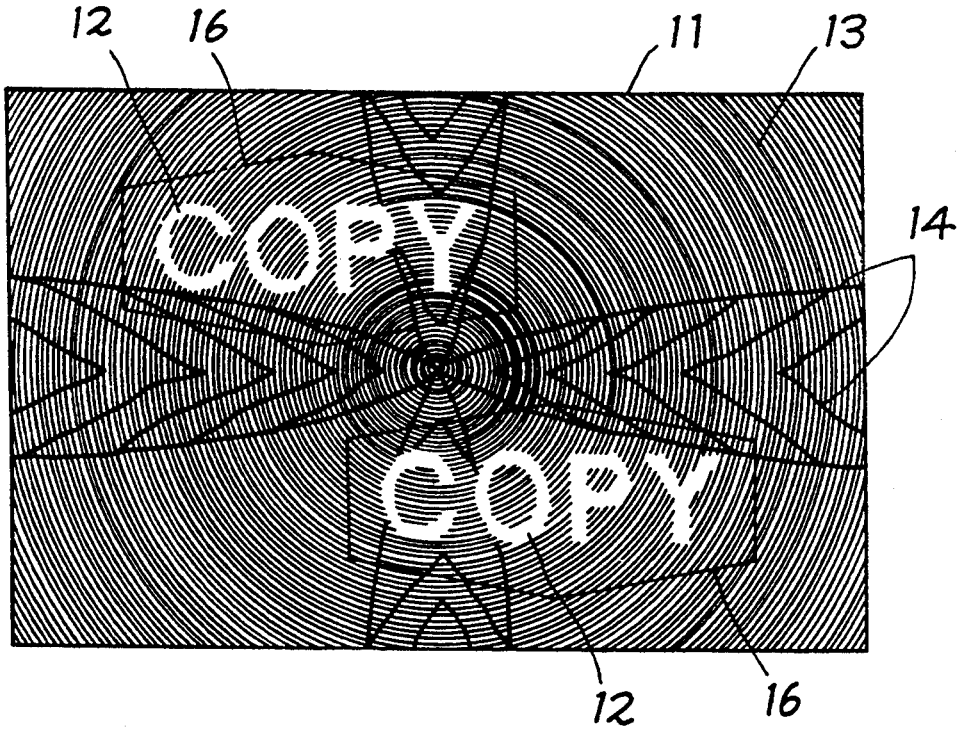
FIG. 7 is a plan view illustrating the paper of FIG. 6 in a state assumed when the paper is subjected to a copying action of a color copying device.

FIG. 7 depicts the paper in a state produced by a copying action of a color copying device. On a copying paper 11, a color pattern 16 faintly appears as though it were an afterimage. The latent image 12 and the background 13 are clearly discriminated from each other because the mesh points of the latent image 12 are not reproduced and the concentric circular patterns of the background 13 are reproduced. Again in this case, a moire 14 is produced in the background.

Figure 8:
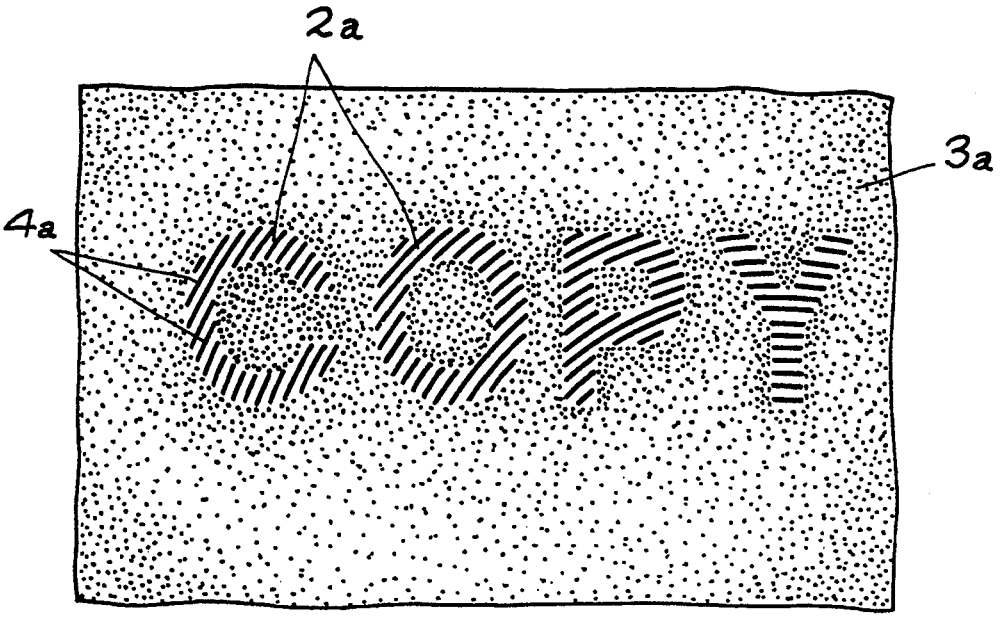
FIG. 8 is a diagram illustrating on an enlarged scale part of the paper in which a latent image is formed with a concentric circular pattern.

FIG. 8 depicts a working example which, unlike the working example cited above, has a latent image 2*a* formed of concentric circular patterns and a background 3*a* formed of mesh points of a 150-line 10% level. The thin lines 4*a* which form the circles of the concentric circular patterns have a thickness of about 1/10 mm and are spaced with an interval of about ½ mm.

The latent image 29 formed of the concentric circular patterns appears in a dark color on a copy because it is reproduced by a copying action of the copying device. The mesh points of the background are not reproduced. The contrast between the latent image 2*a* and the background 3*a* enables the latent image 2*a* to be clearly perceived visually.

Since the concentric circular patterns used in this case, unlike those which form a background, are limited within the surface area of the latent image, no vividly discernible moire is produced by a copying action of a color copying device. Since the concentric circular patterns are not formed linearly in a single direction like the multiplicity of lines and the degrees of curvature of the circles decrease in the direction from inner to outer circles, the thin lines 4*a* of the latent image have varied directions, depending on the position of the latent image, and the degrees of reproduction on a copy are more or less different. When a plurality of latent images are formed at as many portions of the paper, the produced paper is at an advantage in enabling some, if not all, of the latent images to appear very clearly.

The present working example, similarly to the working examples cited above, allows a camouflage pattern to be formed on the latent image 2*a* and the background 3*a* or a color pattern to be printed on the latent image 2*a* at a proper portion thereof in a transparent ink of light color not easily reproduced by copying.

The working examples cited thus far invariably represent cases of forming concentric circular patterns in such a manner that their centers coincide with the center of the paper. It is permissible, however, to have such concentric circular patterns formed at several portions of the paper or to have latent images distributed to several portions of the paper and formed individually of mesh points and concentric circular patterns. These also are modifications which belong to the scope of allowable embodiments of this invention.

As described above, this invention produces the following effects.

(1) The concentric circular patterns are uniformly reproduced on a copy irrespectively of the type of copying device used or the manner of placing the paper relative to the copying device and, therefore, are conspicuously contrasted to the mesh points which are not reproduced. This contrast manifests itself as an obvious difference in darkness and lightness between the latent image and the background on the copy. Thus, the latent image is perceived so clearly as to discourage an attempt at reproduction by copying of the print made on the paper of this invention.

(2) Since the thin lines forming the concentric circular patterns have a specific thickness and are spaced with a specific interval, the concentric circular patterns dazzle unaided eyes and render difficult the discrimination thereof from the mesh points. Thus, the paper is quite sightly because this paper appears to have a uniform flat surface and the latent image escapes visual perception.

(3) Where the latent image is formed of mesh points, the paper enjoys a beautifully finished surface because the concentric circular patterns of the background do not run parallel to the longitudinal, lateral, or oblique linear rows of the mesh points of the latent image and, therefore, void figures due to excessive separation between the latent image and the background or dark portions due to unduly close approximation of the latent image and the background do not occur.

(4) When the background is formed of concentric circular patterns as in the working examples, the paper on being subjected to a copying action of a color copying device gives rise to a moire, an evident sign indicating that the paper is a product of copying. The appearance of this moire coupled with that of the latent image doubly ensures prevention of counterfeiting.

(5) When the latent image is formed of concentric circular patterns, the directions of the thin lines forming the patterns are variable with the position of the latent image. When a plurality of latent images are formed at as many portions of the paper, some if not all of the latent images coincide with the direction of scanning light of the copying device and, therefore, are allowed to appear very clearly.

(6) The incorporation of a camouflage pattern in the paper brings about a decorative effect because the camouflage pattern contributes to further enhancing the perceptibility of the latent image and, at the same time, manifests itself in the form of a fixed subdued pattern throughout the entire area of the paper.

(7) The paper having a colored pattern printed on the latent image in a proper portion thereof with a transparent ink of light color is ideally used for documents requiring a pattern because this color pattern perfectly conceals the latent image.

What is claimed is:

1. A counterfeit-proof paper adapted to discourage an attempt at reproduction of print thereon with a copying device, said counterfeit-proof paper comprising:

a substratum paper;

at least one latent image printed on a surface of said substratum paper in at least one latent image location, respectively, said at least one latent image being formed of approximately 150-line 10% mesh points; and a background printed on said surface of said substratum paper at locations other than said at least one latent image location, said background being formed of a pattern of concentric circles formed by lines with a thickness of about 1/10 mm spaced apart at intervals of about ½ mm;

whereby said at least one latent image is virtually indiscernible on said counterfeit-proof paper but, on a copy made by a copying machine, becomes visually perceptible due to differences in lightness and darkness of the copied latent image relative to the copied background.

2. A counterfeit-proof paper as recited in claim 1, wherein said lines of said background are of the same color as said mesh points of said latent image.

3. A counterfeit-proof paper as recited in claim 1, further comprising a camouflage pattern printed on said surface of said substratum paper in one-layer one-color print in combination with said at least one latent image and said background so as to interfere with visual perception of said at least one latent image on said surface of said substratum paper.

4. A counterfeit-proof paper as recited in claim 1, further comprising a color pattern printed on said at least one latent image with a transparent ink of light color barely reproducible in a copy.

5. A counterfeit-proof paper adapted to discourage an attempt at reproduction of print formed thereon with a copying device, said counterfeit-proof paper comprising:

a substratum paper;

at least one latent image printed on a surface of said substratum paper in at least one latent image location, respectively, said at least one latent image being formed of a pattern of portions of concentric circles formed by lines with a thickness of about 1/10 mm spaced apart at intervals of about ½ mm; and a background printed on said surface of said substratum paper at locations other than said at least one latent image location, said background being formed of approximately 150-line 10% mesh points;

whereby said at least one latent image is virtually indiscernible on said counterfeit-proof paper but, on a copy made by a copying machine, becomes visually perceptible due to differences in lightness and darkness of the copied latent image relative to the copied background.

6. A counterfeit-proof paper as recited in claim 5, wherein said lines of said at least one latent image are of the same color as said mesh points of said background.

7. A counterfeit-proof paper as recited in claim 5, further comprising a camouflage pattern printed on said surface of said substratum paper in one-layer one-color print in combination with said at least one latent image and said background so as to interfere with visual perception of said at least one latent image on said surface of said substratum paper.

8. A counterfeit-proof paper as recited in claim 5, further comprising a color pattern printed on said at least one latent image with a transparent ink of light color barely reproducible in a copy.

* * * * *